US005594929A

United States Patent [19]

Muhammed et al.

[11] Patent Number: 5,594,929

[45] Date of Patent: Jan. 14, 1997

[54] METHOD OF PREPARING POWDERS FOR HARD MATERIALS

[75] Inventors: Mamoun Muhammed, Djursholm; Sverker Wahlberg, Hägersten; Ingmar Grenthe, Österskär, all of Sweden

[73] Assignee: Sandvik AB, Sandviken, Sweden

[21] Appl. No.: 465,356

[22] Filed: Jun. 5, 1995

[30] Foreign Application Priority Data

Jun. 10, 1994 [SE] Sweden ..... 9402081

[51] Int. Cl.[6] ..... B22F 1/00

[52] U.S. Cl. ..... 419/1; 419/14; 419/17; 419/18; 423/53; 423/55; 423/58; 423/61; 423/62; 423/138; 423/140

[58] Field of Search ..... 419/1, 14, 17, 419/18; 423/53, 55, 58, 61, 62, 138, 140

[56] References Cited

U.S. PATENT DOCUMENTS 3,440,035 4/1969 Iwase et al. ..... 75/0.5
4,388,226 6/1983 Derrein et al. ..... 252/465
4,765,952 8/1988 Kemp, Jr. .
5,304,342 4/1994 Hall, Jr. et al. .

FOREIGN PATENT DOCUMENTS 346473 4/1931 United Kingdom .

OTHER PUBLICATIONS

Chemical Abstracts, vol. 120, No. 12, Kim et al., "Production of the ultra fine–composite powders of tungsten carbide–cobalt and tungsten carbide–nickel," Mar. 21, 1994 & Han'Guk Pyomyon Konghak Hoechi, vol. 26, No. 2, 1993 Korea, pp. 87–107.

*Primary Examiner*—Charles T. Jordan
*Assistant Examiner*—Anthony R. Chi
*Attorney, Agent, or Firm*— Burns, Doane, Swecker & Mathis, L.L.P.

[57] ABSTRACT

According to the invention there is now provided a simple method of preparing a powder containing WC and cobalt and/or nickel. APT-powder and a powder of a basic salt of cobalt and/or cobalt are mixed in water or in mixed solvents. The suspension is stirred to react at temperatures ranging from room temperature to the boiling point of the solution whereby a precipitate is formed, which precipitate is filtered off, dried and finally reduced to a metallic powder.

12 Claims, No Drawings

METHOD OF PREPARING POWDERS FOR HARD MATERIALS

BACKGROUND OF THE INVENTION

The present invention relates to a method of preparing fine grain WC—Co(Ni)-powders for use in the manufacture of a cemented carbide.

Cemented carbide and titanium-based carbonitride alloys (often referred to as cermets) contain hard constituents based on carbides, nitrides and/or carbonitrides of Ti, Zr, Hf, V, Nb, Ta, Cr, Mo and/or W in a binder phase essentially based on Co and/or Ni. They are made by powder metallurgical methods of milling a powder mixture containing powders forming the hard constituents and binder phase, pressing and sintering.

The milling operation is an intensive grinding in mills of different sizes with the aid of milling bodies which are usually made of a cemented carbide. The milling time is of the order of several hours up to days. Milling is believed to be necessary in order to obtain a uniform distribution of the binder phase in the milled mixture. It is further believed that the intensive milling increases the reactivity of the mixture which further promotes the formation of a dense structure.

GB 346,473 discloses a method of making cemented carbide bodies. Instead of milling, the hard constituent grains are coated with the binder phase by an electrolytic method, pressed and sintered to a dense structure. This and other similar methods are, however, not suited for cemented carbide production in a large industrial scale and milling is almost exclusively used within the cemented carbide industry today.

However, milling has its disadvantages. Because of the long milling time, the milling bodies wear and contaminate the milled mixture which has to be compensated for. The milling bodies can also break during milling and remain in the structure of the sintered bodies. Furthermore, even after an extended milling, a non-homogenous rather than ideal homogeneous mixture may be obtained. In order to ensure an even distribution of the binder phase in the sintered structure, sintering has to be performed at a higher temperature than the theoretical.

An alternative way is to start from an intimate mixture of cobalt and tungsten, which mixture subsequently is carburized. U.S. Pat. No. 3,440,035 discloses such a method of preparing cemented carbide powder characterized in that an aqueous solution of ammoniumparatungstate (APT) and nitric or hydrochloric aqueous solution of, e.g., cobalt are mixed. The mixture is then subjected to a neutralizing reaction with ammonium hydroxide at a temperature of 20° C. to 80° C. when the pH-value of the mother solution after the reaction is adjusted to be between 4.5 to 8. The resultant fine composite precipitate containing tungsten and cobalt in the desired composition controlled by the reaction conditions is filtered, dried by heating and then subjected to reduction and carburization to obtain a WC—Co-composite powder in which the WC grain size generally is submicron.

OBJECTS AND SUMMARY OF THE INVENTION

It is an object of this invention to avoid or alleviate the problems of the prior art.

It is another object of this invention to provide a method for producing a fine-grained powder of tungsten and cobalt and/or nickel.

It is a further object of this invention to provide a method for producing a powder mixture of tungsten carbide and/or nickel suited for the production of a cemented carbide.

These and other objects are provided by a method of preparing a powder containing tungsten and cobalt and/or nickel comprising mixing ammonium paratungstate and a basic salt of cobalt and/or nickel in water, reacting the mixture at a temperature from ambient to the boiling point of the solution under agitation to form a precipitate powder of tungsten and cobalt and/or nickel and removing the precipitate from the solution.

DETAILED DESCRIPTION OF THE PREFERRED EMBODIMENTS OF THE INVENTION

It has now been found that it is possible to obtain a powder containing cobalt and tungsten mixed at an atomic level in a simple way by adding APT, a white powder with the chemical formula $(NH_4)_{10}H_2W_{12}O_{42}\cdot x\cdot H_2O$ (x=4–11), and cobalt (II) hydroxide, a pink powder with the chemical formula $Co(OH)_2$ both powders having a grain size of about 0.1–100 μm, preferably 1–10 μm, to water. The weight/weight ratio of powder/suspension should be 5–60%, preferably 20–50%, most preferably about 20–30%. The suspension is stirred intensively at temperatures ranging from room temperature to the boiling point of the suspension. APT and $Co(OH)_2$ react to form a cobalt-tungstate-precipitate. During the reaction, gaseous ammonia is formed and leaves the suspension. The time to complete reaction depends on the temperature, cobalt concentration, grain size, stirring rate and powder/suspension ratio, etc. As the reaction proceeds, the color of the suspension changes from white/pink to pink. A more exact determination of the degree of transformation can be made by conventional powder X-ray diffraction analysis. The precipitate is filtered, dried and reduced in a hydrogen atmosphere to a fine homogeneous metallic powder containing intimately mixed Co and tungsten. This mixture may subsequently be carburized either by mixing with carbon and heating or heating the mixture in a carbon-containing gas at a low temperature of about 1000° C. to 1200° C., preferably from about 1050 ° C. to 1150° C. to a WC—Co-powder with a typically submicron grain size. The powder can be mixed with a pressing agent, compacted and sintered to dense cemented carbide. The initial amounts of APT and cobalt (II) hydroxide are chosen so as to give the desired composition of the carburized WC—Co-powder. It has been found that Co-contents of about 1–25 wt %, preferably 3–15 wt %, easily can be obtained but compositions outside that range are also possible.

This process has an extremely simple operation but a complex chemistry controls the conversion. The solubility of APT in water is higher than the solubility of the cobalt hydroxide. It is believed that the dissolution of cobalt hydroxide is enhanced by the dissolution of APT. The dissolved cobalt reacts with the dissolved paratungstate to form the less soluble Co-tungstate that precipitates out of the solution. More APT is then dissolved resulting in more dissolution of cobalt and a continuous transformation of both APT and $Co(OH)_2$ to the cobalt tungstate. The process is thus self-regulating with a surprisingly high reaction rate at elevated temperature.

The method has been described with reference to cobalt but it can also be applied to nickel alone or in combination with cobalt. Instead of cobalt hydroxide (or nickel hydroxide) other basic salts of cobalt (or nickel) like $CoCO_3$ or CoCl(OH) or other insoluble salts such as $COC_2O_4$ can be used alone or in combination. Salts of other transition elements such as of V, Cr and/or Mo may also be added to the water together with the APT and the Co/Ni-salt or to the suspension after APT and the Co/Ni-salt have reacted. The solvent can be water or water mixed with other solvents, e.g., ethanol.

The homogeneous fine metal powder according to the invention can also be used in other applications such as materials for catalysis or in materials for alloys of high density.

The invention is additionally illustrated in connection with the following Examples which are to be considered as illustrative of the presently claimed invention. It should be understood, however, that the invention is not limited to the specific details of the Examples.

EXAMPLE 1

100 g APT was added with 5 g cobalt (II) hydroxide to 300 ml water in a 500 ml glass reactor. The suspension was stirred at 250 rpm and heated to 90° C. to react. Powder samples withdrawn from the reaction mixture were analyzed by XRD. The table below shows the relative amount of cobalt-tungstate isolated from the reaction mixture at given time intervals.

| Reaction time, min | % cobalt-tungstate |
|---|---|
| 30 | 85 |
| 60 | 95 |
| 90 | 100 |
| 120 | 100 |

EXAMPLE 2

70 g APT was together with 5.4 cobalt (II) hydroxide added to 210 ml water in a 500 ml glass reactor. The suspension was stirred at 250 rpm and heated to boil. The heated time from room temperature to the boiling point was 16 min. The powder was after 2 min of boiling filtered off and dried. XRD analysis showed a complete conversion from APT to the cobalt tungstate salt.

EXAMPLE 3

70 g APT was together with 5.4 g cobalt (II) hydroxide added to 210 ml water in a 500 ml glass reactor stirred at 250 rpm. The stirred suspension was left to react during 90 hours at room temperature. The powder was after reaction separated by centrifugation, washed with ethanol and dried at 80° C. for 2 days. XRD analysis showed a complete conversion from APT to the cobalt tungstate salt.

EXAMPLE 4

70 g APT and 5.4 g cobalt (II) hydroxide were added together to 210 ml water in a 500 ml glass reactor. The suspension was stirred at 250 rpm and heated to the boiling point. The time to warm up from room temperature to the boiling point (101° C.) was 15 min. The suspension was, after 2 min at the boiling point, left to cool down to room temperature. 0.53 g ammonium vanadate ($NH_4VO_3$) was added to the suspension and dissolved in the solution. 32 g ammonium acetate ($NH_4Ac$) was added and ammonium vanadate was precipitated on the cobalt-tungstate powder. The Co—W—V salt was filtered off and dried at 80° C. overnight.

EXAMPLE 5

70 g APT, 5.41 g cobalt (II) hydroxide and 0.34 g chromium (III) oxide ($Cr_2O_3$) were added together to 210 ml water in a 500 ml glass reactor. The suspension was stirred 250 rpm and heated to the boiling point (101° C.). The time to warm up from room temperature to the boiling point was 16 min. The temperature was kept at the boiling point for 12 hours. The Co—W—Cr powder was filtered off and dried at 80° overnight.

EXAMPLE 6

APT (1705 g) and cobalt hydroxide (122.4 g) were charged into the reactor. Water (5115 ml) was added and the mixture was stirred at 270 rpm. The reactor was heated, the mixture started to boil after 1 hour. The temperature was 101°±2° C. The reaction was allowed to proceed for two hours, after which the suspension was filtered. The wet powder was washed with ethanol and dried at 100° C. overnight. The final material after reduction, carburization contained 6% Co and 93.6% WC.

EXAMPLE 7

APT (1800 g) and cobalt hydroxide (75.09 g) were charged into the reactor. Water (5400 ml) was added and the mixture was stirred at 270 rpm from start and at 240 rpm when the solution started to boil. The reactor was heated, the mixture was boiling after 1 hour. The temperature of the suspension was 101°±2° C. The reaction was allowed to proceed for two hours, after which the suspension was filtered. The wet powder was washed with ethanol and dried at 100° C. The final material after reduction, carburization and sintering contained 3.7% Co and 96.3% WC.

EXAMPLE 8

APT (1703 g) and cobalt hydroxide (223.75 g) were charged into the reactor. Water (5100 ml) was added and the mixture was stirred at 270 rpm. The reactor was heated, the temperature reached 90° C. after 50 minutes, and was then kept at 90°±2° C. The reaction was allowed to proceed for two hours, after which, the suspension was filtered. The wet powder was washed with ethanol and dried at 100° C. The final material after reduction, carburization and sintering contained 10% Co and 90% WC.

EXAMPLE 9

1.16 g $Cr(ClO_4)_3 \cdot 6H_2O$, 50.00 g APT and 3.75 g $Co(OH)_2$ were mixed with 150 ml water and heated at 90° C. for 2 hours. The powder was filtered off and dried at 100° C.

EXAMPLE 10

50.03 g and 3.76 g $Co(OH)_2$ were mixed with 150 ml water and heated at 90° C. 1.17 g $Cr(C10_4)_3 \cdot 6H_2O$ dissolved in 30 ml water was added to the suspension after 1.5 hours. The W—Co—Cr containing powder was filtered off after 0.5 hours and dried at 100° C.

EXAMPLE 11

3.74 g $Co(OH)_2$, 51.00 g APT and 150 ml water were charged into the reactor. The suspension was stirred and heated at 90° C. for 1.5 hours. 0.38 g $VCl_3$ suspended in 20 ml water was added under stirring. The W—Co—V containing powder was filtered off after 0.5 hours and dried at 100° C.

EXAMPLE 12

3.69 g $Ni(OH)_2$, 50.15 g APT and 150 ml water were charged into the reactor. The suspension was stirred and heated at 90° C. for 4 hours. The W—Ni containing powder was filtered off and dried at 100° C.

EXAMPLE 13

3.89 g $Ni(OH)_2$, 52.67 g APT, 1.6 ml concentrated acetic acid and 158 ml water were charged into the reactor. The suspension was stirred and heated at 90° C. for about 5 hours. The W—Ni containing powder was filtered off and dried at 100° C.

EXAMPLE 14

3.87 g $Co(OH)_2$ and 49.98 g APT were suspended in a water-ethanol (80%/20% ) mixture. The suspension was heated to 66° C. for 3 hours. The W—Co containing powder was filtered off and dried at 100° C.

The principles, preferred embodiments and modes of operation of the presently claimed invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of preparing a powder containing tungsten and cobalt and/or nickel comprising mixing powders of ammonium paratungstate and a water insoluble basic salt of cobalt and/or nickel in water, reacting the mixture of powders and solution at a temperature from ambient to the boiling point of the solution under agitation to form a precipitate powder of tungsten and cobalt and/or nickel and removing the precipitate from the solution.

2. The method of claim 1 wherein said basic salt is a hydroxide.

3. The method of claim 1 wherein at least one salt of a transition metal other than W, Co and No is added to the mixture.

4. The method of claim 3 wherein said salt of a transition metal is a salt of V, Cr and/or Mo.

5. The method of claim 1 wherein said precipitate is dried and heated in a reducing atmosphere to form a metallic powder.

6. The method of claim 5 wherein said metallic powder is further carburized to form a powder containing WC, cobalt and/or nickel.

7. The method of claim 1, wherein the powders of ammonium paratungstate and basic salt of cobalt and/or nickel have a grain size of 0.1–100 μm.

8. The method of claim 1, wherein the powders of ammonium paratungstate and basic salt of cobalt and/or nickel is added to the water in a weight ratio of 5–60% powder.

9. The method of claim 1, wherein the agitation comprises stirring the mixture.

10. The method of claim 1, wherein ammonia is formed during the reacting.

11. The method of claim 5, wherein the metallic powder is mixed with carbon and heated in a carbon-containing gas to form a submicron grain size WC—Co/Ni powder.

12. The method of claim 1, wherein the metallic powder is carburized to form a WC—Co powder having a Co content of 1–25 wt % Co.

* * * * *